United States Patent [19]

Kimura et al.

[11] Patent Number: 4,695,317

[45] Date of Patent: Sep. 22, 1987

[54] METHOD OF TREATING SILICATE ORE CONTAINING GOLD AND SILVER

[75] Inventors: Takayoshi Kimura; Seiichi Tsuyuguchi; Yoshiaki Mori, all of Niihama, Japan

[73] Assignee: Sumitomo Metal Mining Company Limited, Tokyo

[21] Appl. No.: 823,629

[22] Filed: Jan. 29, 1986

[30] Foreign Application Priority Data

Jan. 31, 1985 [JP] Japan ..... 60-17516
Jan. 31, 1985 [JP] Japan ..... 60-17517

[51] Int. Cl.[4] ..... C22B 11/00
[52] U.S. Cl. ..... 75/24; 75/72; 75/83
[58] Field of Search ..... 75/83, 24, 72, 73, 74

[56] References Cited

U.S. PATENT DOCUMENTS

| | | | |
|---|---|---|---|
| 3,674,463 | 7/1972 | Yannopoulos | 75/74 |
| 3,796,568 | 3/1974 | Szekely et al. | 75/72 |
| 4,135,923 | 1/1979 | Day | 75/24 |
| 4,295,881 | 10/1981 | Saville | 75/83 |
| 4,451,289 | 5/1984 | Van Hecke et al. | 75/83 |

*Primary Examiner*—Melvyn J. Andrews
*Attorney, Agent, or Firm*—Watson, Cole, Grindle & Watson

[57] ABSTRACT

A silicate ore containing gold and silver is melted with the slag from a copper converter and a reducing agent. A source of CaO may also be added to the slag so that the treated slag may contain at least 3.0% by weight of CaO. Copper is recovered from the slag and absorbs gold and silver from the ore. This method drastically improves the capacity for the treatment of a silicate ore containing gold and silver during the smelting of copper. It enables the complete melting of the ore without leaving any ore undissolved.

9 Claims, 4 Drawing Figures

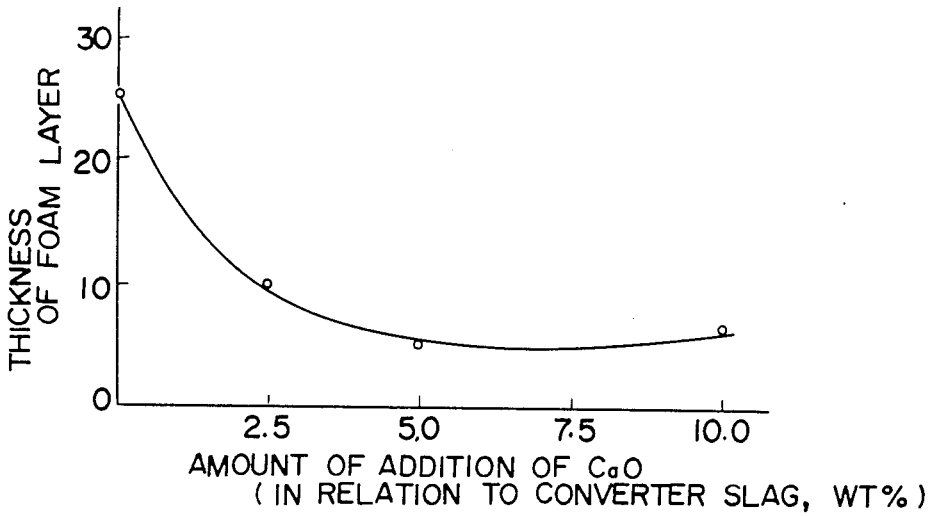
FIG. 4
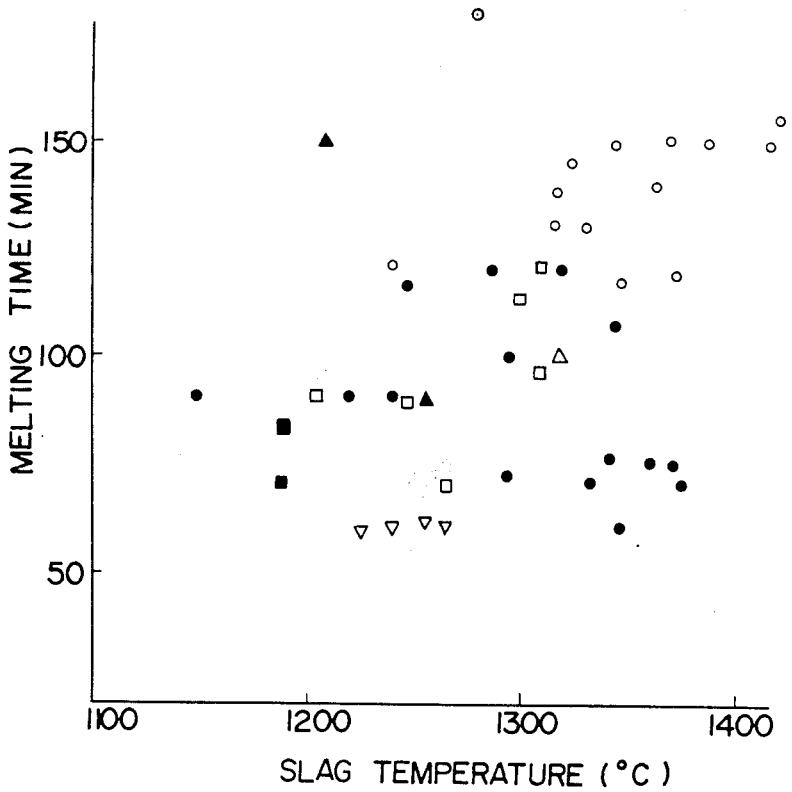

METHOD OF TREATING SILICATE ORE CONTAINING GOLD AND SILVER

BACKGROUND OF THE INVENTION

1. Field of the Invention

This invention relates to a method of efficiently recovering gold and silver from a silicate ore.

2. Description of the Prior Art

There are two main methods known for smelting a silicate ore containing at least 0.1 g of each of gold and silver per ton. One of them is a hydrometallurgical method which is intended only for the recovery of gold and silver. The other is a pyrometallurgical method in which the ore per se is used as a flux for the pyrometallurgical smelting of copper or lead, while gold and silver are recovered as by-products.

Slurry cyaniding is a widely used hydrometallurgical method, but the disposal of the waste solution and tailings which contain cyanogen is a big problem. The thiourea method and flotation are hydrometallurgical methods which do not use any cyanogen solution. The former is, however, still under study and not yet employed in practice (Studies and Prospects of Gold Extraction from Carbon Bearing Clayey Gold Ore by the Thiourea Process, Chen Deng Wen: Preprints—The Canadian Institute of Mining and Metallurgy, XIV International Mineral Processing Congress, Toronto, Canada, Oct. 17-23, 1982, II—8.1 to II—8.11). The latter can only recover gold and silver at a low yield (about 93% in the case of gold—The Japanese Association of the Mining Industry: Report on the Principal Costs of Flotation and Cyaniding, 1981).

The method in which the ore is used as a flux in, for example, a flash smelting furnace or converter for copper has the disadvantage that the resulting slag has an Fe (%)/$SiO_2$(%) ratio which is limited by its physical properties. The ratio is about 1.0 in the case of a slag from a flash smelting furnace and about 1.8 to 2.0 in the case of a converter slag. Any attempt to melt the silicate ore until a lower $FeO/SiO_2$ ratio is reached gives rise to a great increase in the viscosity and melting point of the slag (The Japan Institute of Metals: Nonferrous Smelting, p. 63), resulting in an increased loss of copper to the slag. It is necessary to raise the molten bath temperature in order to cope with any such increase in the viscosity and melting point of the slag. It is, however, practically difficult to employ a higher molten bath temperature, since it promotes the erosion of the refractories. The converter slag usually contains 25 to 35% of $Fe_3O_4$. Even a small increase of $SiO_2$ greatly raises the melting point of the slag. A part of the silicate ore remains undissolved with a resultant reduction in the primary yield of recovered gold and silver.

SUMMARY OF THE INVENTION

It is a primary object of this invention to provide a novel method of melting a silicate ore containing gold and silver to recover the gold and silver effectively, and which can drastically increase the capacity of treating any such ore in the field of copper smelting.

According to a first aspect of this invention, its object is attained by a method which comprises melting a silicate ore containing gold and silver with the slag from a copper converter and a reducing agent, so that the copper extracted from the slag may absorb the gold and silver.

This method can drastically increase the capacity of treating the ore, but the slag which is composed of FeO, $Fe_2O_3$ and $SiO_2$ finally contains a saturated amount of $SiO_2$. If there is a slight drop in temperature or a slight change in composition, it is likely that some of the ore may remain undissolved, with a resultant reduction in the yield of gold and silver recovery. The ore melts rather slowly and requires a high temperature and a long time for its complete dissolution. The use of a still higher temperature for shortening the melting time is likely to cause the erosion of the refractories. When a reducing agent is blown into the converter through its tuyeres or top lancing tube, the slag foams heavily as the silicate ore is dissolved therein. This increases the slopping of the slag out of the furnace and the material which is recycled. Moreover, it is possible that the hot molten material may blow out of the furnace.

It is, therefore, another object of this invention to provide a method which can completely melt a silicate ore container gold and silver in a short time, while reducting the slag from a copper converter, to decrease the consumption of the fuel maintaining the temperature of the molten bath, prolong the life of the refractories and prevent the foaming and slopping of the slag.

According to a second aspect of this invention, its object is attained by a method which comprises melting a silicate ore containing gold and silver with the slag from a copper converter and a reducing agent so that the copper extracted from the slag may absorb the gold and silver, characterized by adding a source of CaO to the slag so that the treated slag may contain at least 3.0% by weight of CaO.

The method of this invention enables the efficient recovery of gold and silver from a silicate ore, while simultaneously accomplishing the cleaning of the slag from a copper converter. Thus, it can drastically increase the capacity of treating such silicate ore during the smelting of copper.

The addition of a reducing agent enables the treatment of the silicate ore until the $SiO_2$ content of the slag is comparable to that of the slag from a matte smelting furnace of, for example, the flash or reverberatory type. As a low $Fe/SiO_2$ ratio is maintained, this invention is advantageous for the reduction of $Fe_3O_4$ and effective for preventing the overreduction which would otherwise be likely to occur to even Fe at a high temperature.

The addition of a source of CaO accelerates the complete melting of the ore and thereby makes it possible to decrease the consumption of fuel, to prolong the life of the furnace refractories and to prevent the slopping of the slag. Therefore, it is possible to decrease the amounts of the material which blows out and the material which is recycled, and the handling loss of gold and silver, and thereby improve productivity.

BRIEF DESCRIPTION OF THE DRAWINGS

FIG. 3 is a graph showing the thickness of a foam layer formed on the slag of a copper converter when the slag to which a silicate ore containing gold and silver, limestone powder and pulverized coal had been added was cooled, in relation to the amount of the limestone; and FIG. 4 is a graph showing the results of silicate ore melting as obtained when it was melted with the slag from a copper converter and pulverized coal, and when limestone was further added, in relation to the slag temperature and the melting time.

DETAILED DESCRIPTION OF THE INVENTION

According to this invention, a reducing agent is added to the molten slag from a copper converter to reduce $Fe_3O_4$ therein. The viscosity of the slag is lowered, the copper suspended in the slag settles down, and a part of the copper oxide is reduced. If a silicate ore containing gold and silver is added during the progress of those reducing reactions, gold and silver are absorbed into the copper which settles down and $SiO_2$ forms a fayalite slag with the FeO which is produced by the reduction of $Fe_3O_4$. As the reducing agent is added to the slag from a copper converter while the silicate ore is also added, the reduction takes place at a lower $Fe/SiO_2$ ratio than what is achieved during the mere cleaning of the slag by reduction. The resulting slag has a smaller activity of FeO and $Fe_3O_4$ is, therefore, easier to reduce. It is also possible to prevent any over-reduction to Fe that is likely to occur at a high temperature.

In order to add the reducing agent, it is possible to use a metallurgical furnace having tuyeres, for example, a nonferrous metal smelting converter, and blow pulverized coal and oxygen-enriched air into the slag through the tuyeres. Alternatively, it is possible to use a top lance. It is also possible to use an electric furnace or a furnace having a burner for heat compensation and introduce a reducing agent, such as coal, into the slag. A reducing gas, such as propane, can also be employed.

The slag temperature drops with the progress of reduction or the addition of the silicate ore. It is necessary to maintain a temperature of 1200° C. to 1300° C. to melt the ore completely. If the slag temperature is lower than 1200° C., heavy slopping occurs and the ore remains undissolved. A temperature exceeding 1300° C. should also be avoided, since it causes the heavy erosion of the refractories and also heavy slopping. Therefore, it is necessary to control the rate at which the silicate ore is added, using an auxiliary burner for heat compensation, to control the load of an electric furnace if one is used, and to control the oxygen content and temperature of the air if pulverized coal and oxygen-enriched air are blown through the tuyeres.

The loss of gold and silver to the slag depends on the final copper content of the slag and the gold and silver contents of the copper recovered from the slag, since it is in the majority of the cases due to the mechanical suspension in the slag of the copper-containing particles which have absorbed gold and silver.

Figure 1:
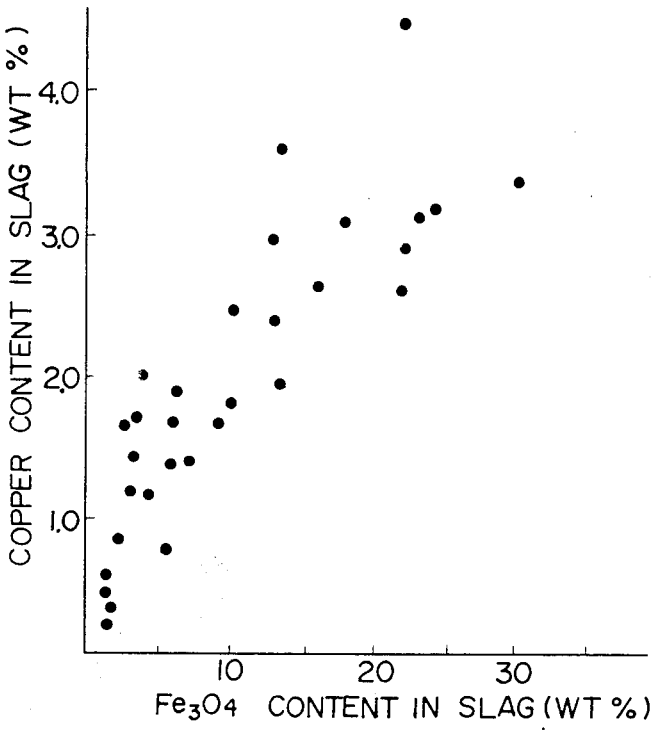
FIG. 1 is a graph showing the copper content of the slag in relation to its $Fe_3O_4$ content.

The copper content of the slag is affected by its $Fe_3O_4$ content. The inventors of this invention melted a silicate ore in a PS converter having a slag treating capacity of three to four tons per charge by blowing pulverized coal and air through its tuyeres until the slag finally had an $Fe/SiO_2$ ratio of about 1.0. The results are shown in FIG. 1. It has been found that in order to lower the final copper content of the slag to about 0.5% by weight, it is advisable to lower its final $Fe_3O_4$ content to a level not exceeding 2% by weight.

Figure 2:
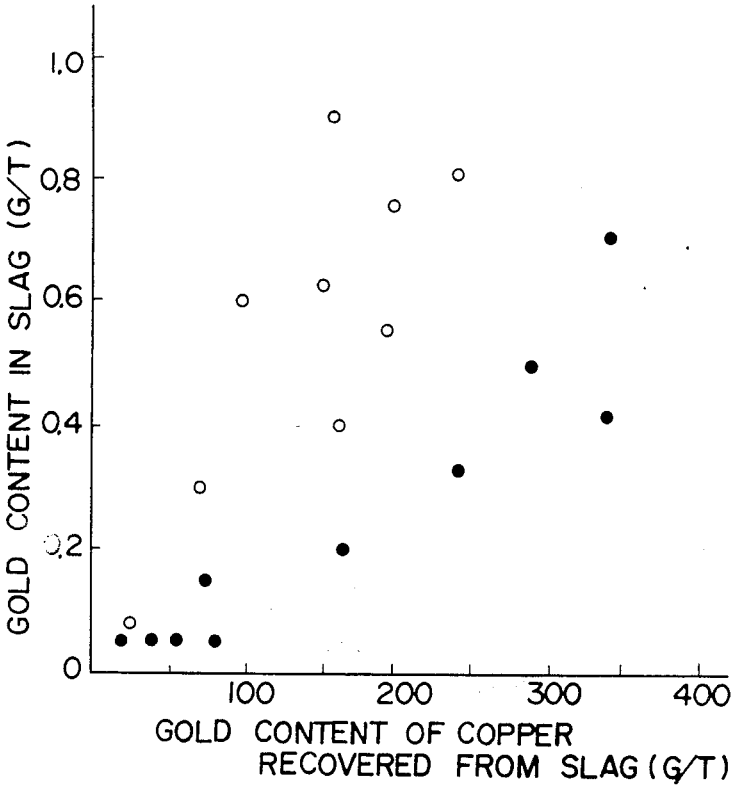
FIG. 2 is a graph showing the gold content of the copper recovered from the slag in relation to the gold content of the slag.

The inventors examined the relationship between the gold content of the copper recovered from the slag and the final gold content of the slag by employing silicate ores having different gold contents and different amounts of recovered copper. The results are shown in FIG. 2, in which the black circles indicate that the slag had a final copper content not exceeding 0.5% by weight, while the white circles indicate that the slag had a final copper content of 0.7 to 1% by weight. As is obvious therefrom, it is advisable to lower the final copper content of the slag to a level not exceeding 0.5% by weight and the gold content of the recovered copper to a level not exceeding 60 g/ton in order to lower the final gold content of the slag to a level not exceeding 0.1 g/ton. In order to lower the final gold content of the slag to a level not exceeding 0.2 g/ton, it is advisable to lower the final copper content of the slag to a level not exceeding 0.5% by weight and the gold content of the recovered copper to a level not exceeding 170 g/ton. The same is presumably the case with silver. Therefore, if the gold and silver contents of a silicate ore are too high for the copper recovered from a converter slag, it is advisable to add a substance containing copper, such as an anode furnace slag or copper residue, in order to lower the gold and silver contents of the recovered copper.

The silicate ore can be treated until the slag has a final $Fe/SiO_2$ ratio of about 0.8. The finer the particle size, the higher the melting speed is. Lump ore having a size of, say, 20 mm can, however, be melted if a temperature of 1200° C. to 1300° C. is maintained for, say, 100 to 150 minutes. Lump ore can be fed through the working mouth of the furnace and pulverized ore can be blown through the tuyeres or lance.

The inventors tested the addition of a source of CaO as will hereunder be described. The slag from a converter, pulverized silicate ore containing gold and silver, limestone powder and 2% by weight of pulverized coal were melted at 1250° C. for an hour in the presence of nitrogen gas in an alumina tammann tube on a laboratory scale. The slag had an $Fe/SiO_2$ ratio of 0.8. After the molten material had been cooled, the thickness of a foam layer (a mixture of foams and slag on the dense slag layer) was measured. The results are shown in FIG. 3. The foam has a large thickness if less than 2.5% by weight of CaO is added (or if the slag contains less than 3.0% by weight of CaO). The foaming and slopping of the slag are very likely to occur. It is necessary for the slag to contain at least 3.0% by weight of CaO. No correspondingly improved results can, however, be expected even if the slag contains more than, say, 13% by weight of CaO. The source of CaO may be limestone or quicklime. While various shapes of limestone or quicklime can be added by various methods, it is usually sufficient to throw lumps into the furnace.

The slag finally contains only small amounts of copper, gold and silver and can be thrown away. The recovered copper, however, still contains a large amount of impurities, such as iron, and must be treated in an ordinary copper smelting converter.

The invention will now be described with reference to several examples thereof.

EXAMPLE 1

A PS converter lined with a brick wall having an inside diameter of 1.5 m and an inside length of 1.7 m was charged with three tons of a copper converter slag of the composition shown in Table 1. Pulverized coal was blown into the converter through four tuyeres having an inside diameter of 21 mm at a rate of 4.6 kg/min. by oxygen-enriched air having an average flow rate of 15.1 $Nm^3$/min. and an average oxygen content of 25.6% by volume. At the same time, 1.0 ton of 15 to 20 mm lump silicate ore of the composition shown in Table 1 was charged into the converter by a chute which had been inserted through its working mouth. The blowing time was 150 minutes. The silicate ore was continuously charged during the first 90 minutes.

The final product had a weight of 3.5 tons of slag and 0.15 ton of copper was recovered. Their compositions are also shown in Table 1. The recovered copper contained 96% by weight each of gold and silver.

TABLE 1

| | Cu (wt. %) | Fe (wt. %) | $SiO_2$ (wt. %) | Au (g/ton) | Ag (g/ton) |
|---|---|---|---|---|---|
| Slag | 4.5 | 45.0 | 20.0 | 0.2 | 10 |
| Silicate ore | — | 1.0 | 84.0 | 20 | 10 |
| Final slag | 0.4 | 38.0 | 39.5 | 0.1 | <1.0 |
| Recovered copper | 80.3 | 3.0 | — | 132 | 256 |

EXAMPLE 2

The procedure of Example 1 was substantially repeated for treating a silicate ore containing gold and silver in the converter used in Example 1. Three tons of a copper converter slag, one ton of silicate ore and 0.6 ton of an anode furnace slag were treated. Their compositions are shown in Table 2. There were obtained 3.7 tons of a final slag and 0.54 ton of recovered copper, of which the compositions are shown in Table 2. The copper recovered 98% by weight of gold and silver from the silicate ore.

Oxygen-enriched air having an average oxygen content of 26.9% by volume was blown through the tuyeres at an average rate of 15.9 $Nm^3$/min. Pulverized coal was fed at a rate of 4.8 kg/min. Example 1 was repeated for the blowing time and the manner in which the silicate ore was charged.

TABLE 2

| | Cu (wt. %) | Fe (wt. %) | $SiO_2$ (wt. %) | Au (g/ton) | Ag (g/ton) |
|---|---|---|---|---|---|
| Copper converter slag | 4.5 | 45.0 | 20.0 | 0.2 | 10 |
| Anode furnace slag | 60.0 | 9.0 | 10.4 | 0.2 | 42 |
| Silicate ore | — | 1.0 | 84.0 | 20 | 10 |
| Final slag | 0.5 | 36.2 | 37.4 | <0.1 | <0.1 |
| Recovered copper | 87.0 | 1.0 | — | 37.4 | 118 |

EXAMPLE 3

A PS converter used in Example 1 was charged with two to four tons of a copper converter slag of the composition shown in Table 3. Pulverized coal was blown in the quantity of 10 to 20% by weight of the slag by oxygen-enriched air having an oxygen content of 25 to 33%; by volume and a flow rate of 15 to 20 $Nm^3$/min. through four tuyeres. A silicate ore of the composition shown in Table 3 was continuously supplied until the slag had an $Fe/SiO_2$ ratio of 0.8 to 1.0. Limestone was also continuously supplied until the slag had a CaO content of 7% by weight. The material in lump form was supplied by a chute inserted through the working mouth of the converter. The material in powder form was supplied through the tuyeres or lances.

After blowing had been continued for a certain period of time, the converter was tilted to discharge the slag and the copper recovered therefrom. The speed at which the silicate ore was supplied and the oxygen content of the oxygen-enriched air which was blown through the tuyeres were controlled to maintain the slag at or near a temperature of 1200° C. to 1300° C.

The silicate ore contained 85.0% by weight of $SiO_2$. It was either in the form of lumps having a size of 15 to 30 mm, or a powder containing 70% by weight of particles having a particle size not exceeding 200 mesh. The limestone was in the form of lumps having a size of 10 to 20 mm.

TABLE 3

| | Cu (wt. %) | Fe (wt. %) | $SiO_2$ (wt. %) | CaO (wt. %) | Au (g/ton) | Ag (g/ton) |
|---|---|---|---|---|---|---|
| Slag | 4.5 | 45.0 | 20.0 | 1.0 | 0.2 | 10 |
| Silicate ore | — | 1.0 | 85.0 | — | 20 | 10 |

About 96 to 98% by weight of gold and silver were recovered from the ore.

FIG. 4 shows the results of silicate ore melting in relation to the melting time and the slag temperature. The black squares in FIG. 4 indicate that some lump silicate ore remained undissolved when the slag had an $Fe/SiO_2$ ratio of 1.0 and a CaO content of 7% by weight. The white squares indicate that no ore remained undissolved. The black triangles indicate that some lump silicate ore remained undissolved when the slag had an $Fe/SiO_2$ ratio of 0.8 and a CaO content of 7% by weight, while the white triangles indicate that no ore remained undissolved. The inverted white triangles indicate that no powdery silicate ore remained undissolved when the slag had an $Fe/SiO_2$ ratio of 1.0 and a CaO content of 7% by weight. As is obvious from FIG. 4, the lump ore can be melted to an improved degree if the slag has a temperature of 1200° C. to 1300° C. and an $Fe/SiO_2$ ratio of 1.0 when 7% by weight of CaO is added. The use of powdery ore produces still better results.

Table 4 shows how the addition of CaO and the control of the slag temperature are effective for preventing the slopping of the slag. In Examples 3-1 and 3-2, limestone was used and the speed at which the silicate ore was supplied and the oxygen content of the oxygen-enriched air were accurately controlled to maintain a slag temperature of 1200° C. to 1300° C. The amount of the material which was blown out through the working mouth of the converter was substantially reduced. This means that the slopping of the slag could be substantially prevented.

TABLE 4

| | Number of charges | Limestone | Temperature control | Converter slag (kg/charge) | Blown out material (wt. % of slag) |
|---|---|---|---|---|---|
| EXAMPLE 3-1 | 17 | Added | The slag temp. was accurately controlled to 1200° C. to | 3124 | 7.0 |

TABLE 4-continued

| | Number of charges | Lime-stone | Temperature control | Converter slag (kg/charge) | Blown out material (wt. % of slag) |
|---|---|---|---|---|---|
| | | | 1300° C. | | |
| 3-2 | 6 | Added | The slag temp. was accurately controlled to 1200° C. to 1300° C. | 3900 | 5.1 |
| COMPARATIVE EXAMPLE | | | | | |
| 1 | 52 | Not added | The slag temp. was allowed to vary until a final level of about 1100° C. | 4195 | 41.0 |
| 2 | 27 | Not added | The slag temp. was allowed to vary until a final level of 1350° C. to 1400° C. | 2180 | 24.5 |
| 3 | 21 | Not added | The slag temp. was accurately controlled to 1250° C. to 1300° C. | 3139 | 10.5 |

Table 5 shows how the addition of CaO and the control of the slag temperature are effective for preventing any serious erosion of the refractories for the converter.

TABLE 5

| | Number of charges | Lime-stone | Temperature control | Erosion of refractories (mm/charge) Gas zone | Molten bath zone | Tuyeres |
|---|---|---|---|---|---|---|
| EXAMPLE | | | | | | |
| 3 | 129 | Added | The slag temp. was accurately controlled to 1200° C. to 1300° C. | 1.5 to 2.5 | 1.0 to 1.6 | 1.5 to 1.6 |
| COMPARATIVE EXAMPLE | 52 | Not added | The slag temp. was allowed to vary until a final level of 1300° C. or above. | 3.0 to 5.0 | 1.7 to 3.0 | 1.7 to 2.3 |

In Example 3, limestone was added and the speed at which the silicate ore was supplied and the oxygen content of the oxygen-enriched air were precisely controlled to maintain a slag temperature of 1200° C. to 1300° C. The appropriate control of the slag temperature and the prevention of slopping enable a reduction in the erosion of the refractories in any portion of the converter.

COMPARATIVE EXAMPLE

The procedure of Example 3 was repeated unless otherwise stated. The slag temperature was controlled when required, or allowed to vary. Referring to FIG. 4, the black circles indicate that some lump silicate ore remained undissolved when the slag had an $Fe/SiO_2$ ratio of 1.0, while the white circles indicate that no ore remained undissolved. In either event, no limestone was added. The results shown in FIG. 4 teach that if no limestone is added, some ore is likely to remain undissolved unless a high slag temperature exceeding about 1300° C. and a long melting time of at least about 100 minutes are employed.

Referring again on Table 4, no limestone was added in Comparative Example 1, nor was any oxygen-enriched air used. The slag temperature was allowed to vary and finally dropped to about 1100° C. As a result, heavy slopping occurred. In Comparative Example 2, no limestone was added, but the oxygen content of oxygen-enriched air was held at a constant level. The silicate ore was supplied at a constant rate. The slag temperature was allowed to vary and reached as high as 1350° C. to 1400° C. When it exceeded 1300° C., heavy slopping occurred, and a large amount of molten material was blown out despite a reduction in the amount of the slag per charge. In Comparative Example 3, no limestone was added, but the oxygen content of the oxygen-enriched air and the speed at which the ore was supplied were controlled to maintain a slag temperature of 1250° C. to 1300° C.

Referring to the Comparative Example in Table 5, no limestone was added, and the slag temperature was allowed to vary until it finally reached a level exceeding 1300° C.

What is claimed is:

1. A method of treating a silicate ore containing gold and silver which comprises the steps of (1) providing a molten slag from a copper converter, said molten slag containing copper and iron, (2) providing a reducing agent, (3) adding said silicate ore containing gold and silver to said molten slag and said reducing agent so as to produce a treated slag and a precipitate of copper with absorbed gold and silver, and (4) recovering the precipitate of copper with absorbed gold and silver.

2. A method as defined in claim 1, wherein said molten slag provided in step (1) has a temperature of 1200° C. to 1300° C., and including between steps (1) and (4) a step (3) of adding a sufficient amount of a CaO-providing material to said molten slag such that said molten slag will contain at least 3.0% by weight of CaO.

3. A method as defined in claim 2, including the step of maintaining the temperature of said molten slag at 1200° C. to 1300° C. during step (3).

4. A method as defined in claim 2, wherein sufficient CaO-providing material is added to said molten slag such that it will contain 3 to 13% by weight of CaO.

5. A method as defined in claim 2, wherein said CaO-providing material is limestone or quicklime.

6. A method as defined in claim 1, wherein said reducing agent includes pulverized coal, and wherein in step (3) pulverized coal is blown into said molten slag in a stream of oxygen-enriched air.

7. A method as defined in claim 1, wherein said reducing agent is pulverized coal, and wherein in step (3) the pulverized coal is thrown into said molten slag.

8. A method as defined in claim 1, wherein said reducing agent is a reducing gas, and wherein step (3) the reducing gas is blown into said molten slag.

9. A method as defined in claim 1, wherein sufficient silicate ore containing gold and silver is added to said molten slag in step (3) to provide said treated slag with an $Fe/SiO_2$ ratio of 0.8 to 1.0.

* * * * *